United States Patent [19]

Carpenter

[11] Patent Number: 4,679,504

[45] Date of Patent: Jul. 14, 1987

[54] HELICOPTER ROTOR FOULING

[75] Inventor: Richard H. Carpenter, Alexandria, Va.

[73] Assignee: Commonwealth Technology Incorporated, Alexandria, Va.

[21] Appl. No.: 677,484

[22] Filed: Dec. 3, 1984

[51] Int. Cl.[4] ..... F42B 4/12

[52] U.S. Cl. ..... 102/348; 102/504; 89/1.11

[58] Field of Search ..... 102/504–506, 102/348, 354; 89/1.11, 36.16

[56] References Cited

U.S. PATENT DOCUMENTS

| | | | |
|---|---|---|---|
| 2,274,264 | 2/1942 | Bickel | 102/504 |
| 2,379,203 | 6/1945 | Vertzinsky | 102/504 |
| 4,130,059 | 12/1978 | Block et al. | 102/505 X |
| 4,294,157 | 10/1981 | Stancil | 102/504 X |
| 4,367,680 | 1/1983 | Hart | 102/504 X |
| 4,397,644 | 5/1982 | Stancil | 102/504 |
| 4,404,912 | 9/1983 | Sindermann | 102/505 |
| 4,505,179 | 3/1985 | Nelson et al. | 102/504 X |

FOREIGN PATENT DOCUMENTS

| | | | |
|---|---|---|---|
| 2753494 | 6/1979 | Fed. Rep. of Germany | 102/504 |
| 540284 | 10/1941 | United Kingdom | 102/504 |

*Primary Examiner*—Peter A. Nelson

*Attorney, Agent, or Firm*—Larson and Taylor

[57] ABSTRACT

A method and apparatus for fouling the rotor system of a helicopter positioned in a localized space is disclosed. One end of a long flexible line is attached to a carrier and the carrier is propelled from a launch point so as to overfly the localized space. The flexible line is progressively played out from the launch point and over the localized space as the carrier overflies the localized space. The playing out of the flexible line attached to the carrier is terminated before the distal end is substantially pulled from the launch point so that the played out line falls to the ground with one end trailing along the ground. Preferably, the end of the flexible line in the air and the carrier are attached to a parachute to slow the descent of the flexible line and carrier to the ground. A number of flexible lines can also be simultaneously played out to form a grid or net of slowly descending lines.

9 Claims, 3 Drawing Figures

HELICOPTER ROTOR FOULING

FIELD OF THE INVENTION

The present invention relates generally to the fouling of a rotor system of a helicopter with a flexible line, and more particularly to the deployment of a long flexible line in a position to foul a helicopter located in a localized area.

BACKGROUND OF THE INVENTION

It has been recognized in the prior art that the rotor system of a helicopter or airplane can be fouled and disabled by use of a flexible cable or the like. For example, in U.S. Pat. No. 2,285,789 (Woolley), an airplane trap is disclosed which consists of a parachute and a coil of resilient wire. The device is preferably dropped from airplanes at great height and a parachute is attached to one end to slow the descent of the wire which unwinds from the coil. Also disclosed in U.S. Pat. No. 2,339,921 (Fraser) is an antiaircraft projectile which includes a spooled cable, a parachute attached to one end of the cable, and a weighted member at the other end of the cable. The projectile is fired into the air with an appropriate time fuse to discharge the cable at the appropriate height. The parachute then opens and the cable unwinds as the weight pulls the other end of the cable away from the parachute. The unwound cable then drifts to earth.

While the above-identified devices have been disclosed for use with fouling propellers of aircraft, a device for fouling the rotor system of a helicopter has also been disclosed. In U.S. Pat. Nos. 4,294,157 and 4,327,644 (Stancil), a projectile deployed cable weapon system which is intended to settle on a helicopter rotor is disclosed. The cable of the device is designed to be shot into the air to an approximately horizontal position from which the cable then drifts to earth. In order to slow the horizontal velocity component of the cable, a drag increasing means is provided at the trailing end of the cable. The cable can be launched by a rocket or the like containing a submunition to deploy the cable.

SUMMARY OF THE INVENTION

In accordance with the present invention, a method and apparatus for fouling a rotor system of a helicopter positioned within a localized space is provided. The rotor system of the helicopter is fouled by use of a long flexible line. According to the method, the long flexible line is attached at one end to a carrier, with the line being located at an initial launch point. The carrier is then deployed from the launch point so as to overfly the localized space. The long flexible line is then played out progressively from the launch point and over the localized space as the carrier overflies the localized space. The playing out of the flexible line is terminated before the distal end of the line is substantially pulled from the ground. In this manner, the played out line then falls to the ground over the localized space with the distal end of the line trailing on the ground so that the blades of a helicopter rotor system located in the localized space beneath the line are ultimately fouled.

In the preferred embodiment of the present invention, a parachute is released from the carrier so that upon release the parachute opens and the flexible line and carrier slowly float to the ground. If desired, the distal end of the flexible line can be attached to the device which is used to launch the carrier to assure that the distal end of the flexible line always remains trailing on the ground. Preferably, the carrier is an easily transportable rocket means including a rocket and a launch tube.

Where appropriate, a number of lines having trajectories approximately parallel to one another can be used to form a grid or net of slowly descending lines. In this manner, a large localized area is provided in which the rotor system of a helicopter is fouled.

It is an advantage of the present invention that it is usable in any locale, and in particular it is safe for use in congested areas or other urban areas where conventional gun fire or the like would not be usable or advisable.

It is also an advantage of the present invention that the probability of placing the flexible line within the swept area of the helicopter rotor system is enhanced by a long line with the distal end on the ground up-range of the helicopter and the proximal end elevated and down-range from the helicopter.

It is a further advantage of the present invention that the probability of placing the flexible line within the swept area of the helicopter rotor system is enhanced by a minimal accuracy required in range. The carrier is required only to overfly the target.

It is still another advantage of the present invention that the probability of placing the flexible line within the swept area of the helicopter rotor system is enhanced by the trailing line which stabilizes the carrier while in flight.

It is still another advantage of the present invention that the probability of placing the flexible line within the swept area of the helicopter rotor system is enhanced by the trailing line which provides a means for visually tracking the carrier while in flight thus allowing succeeding shots to be corrected for crosswinds and the like.

It is still another advantage of the preferred embodiment of the present invention that there is no hazard to persons or property from freely falling components of the invention.

Yet another advantage of the present invention is that the helicopter fouling system can be used not only to prevent egress from a localized space, but to prevent access to the localized space as well by launching a flexible line in the localized space upon approach of a helicopter.

It is also an advantage of the present invention that after the flexible line is deployed and has settled to ground, the keeping of the distal end of the flexible line adjacent the launch point allows for the the easy recovery of the flexible line if needed to clear the line from a congested area or if desired for reuse.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
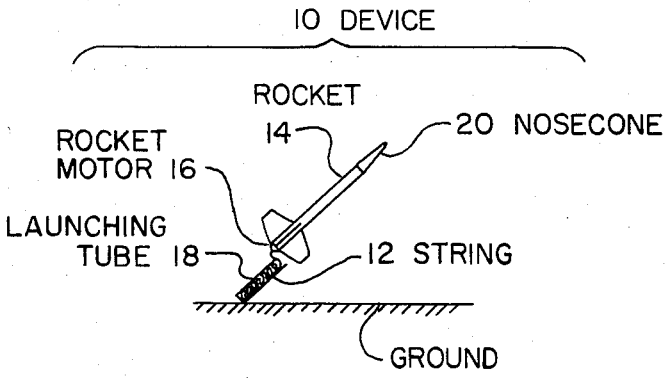
FIG. 1 is a schematic elevation view of the present invention before deployment of the flexible line to foul a helicopter rotor sytem.
Figure 2:
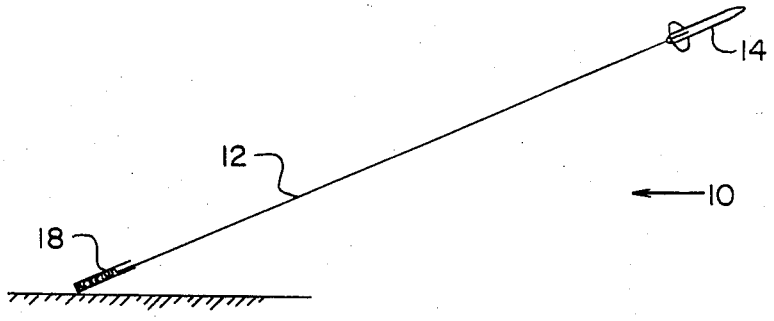
FIG. 2 is a schematic elevation view of the present invention during deployment of the flexible line.
Figure 3:
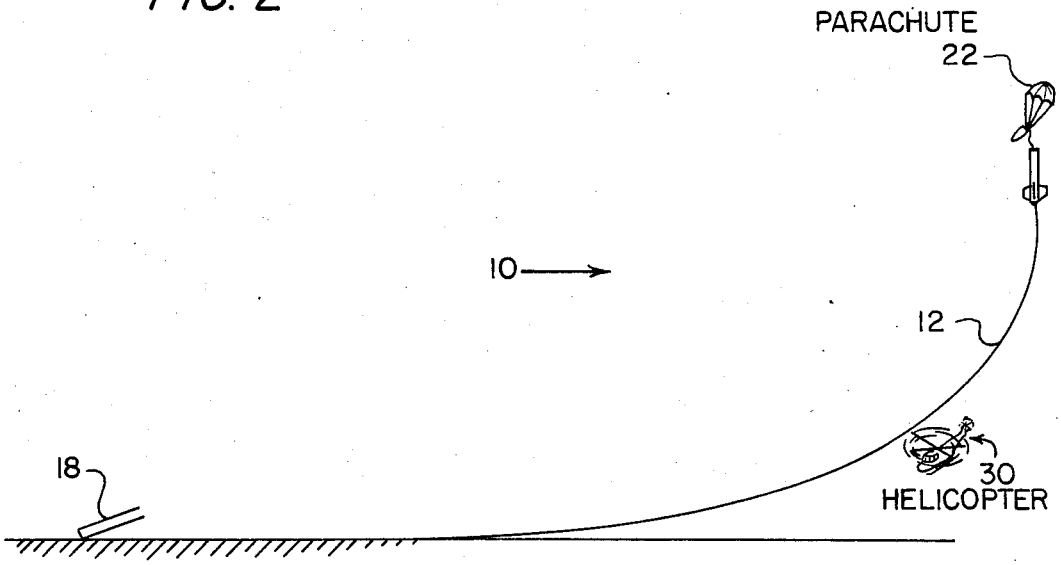
FIG. 3 is a schematic elevation view of the present invention after deployment of the flexible line.

With reference now to the drawings in which like numerals represent like elements throughout the three views, a presently preferred embodiment of a helicopter rotor fouling apparatus 10 is depicted. Fouling apparatus 10 includes a fouling line 12 which is made of a suitable strong and light-weight material such as KEVLAR. Conveniently, fouling line 12 is approximately 2,000 feet long.

Fouling apparatus 10 also includes a suitable carrier 14 for fouling line 12. In this preferred embodiment, carrier 14 is propelled by a class "C" rocket motor 16 which is easily transportable and which can be transported in the U.S. without restriction. A launching tube 18 is also provided for rocket motor 16.

Carrier 14 includes a submunition 20 therein. Submunition 20 carries a parachute 22 to which carrier 14 and one end of fouling line 12 are attached. Submunition 20 is carried by carrier 14 for a predetermined distance dependent upon the length of fouling line 12. When this predetermined distance is reached, submunition 20 fires and deploys parachute 22 from carrier 14. This terminates the playing out of fouling line 12.

The predetermined distance at which submunition 20 is designed to fire is that distance at which fouling line 12 is almost completely played out. However, it is an important feature of the present invention that the trailing end of fouling line 12 remains on the ground. To insure that this occurs, the predetermined distance can be somewhat less than the length of fouling line 12. In addition, the trailing end of fouling line 12 can also be attached to launch tube 18.

In operation, helicopter rotor fouling apparatus 10 functions in the following manner to foul the rotor system of a helicopter 30 which is flying in a localized space adjacent fouling apparatus 10. Initially, after setting up fouling apparatus 10, carrier 14 is launched by rocket motor 16 from launch tube 18 along a desired trajectory over the localized space. It should be appreciated that the in-flight stability of said carrier 14 is enhanced by the trailing of flexible line 12. Where fouling line 12 is approximately 2,000 feet long, the trajectory of carrier 14 would be such as to carry fouling line 12 to a height of approximately 500 feet.

After a predetermined distance of flight of carrier 14, submunition 20 is fired to deploy parachute 22. The end of fouling line 12 is preferably attached to carrier 14 so that fouling line 12 and carrier 14 then slowly float to the ground with parachute 22 with fouling line 12 fouling the rotor system of any helicopter 30 located therebeneath. It should be appreciated, as mentioned above, that the end of fouling line 12 not attached to carrier 14 is trailing along the ground so that fouling line 12 does not inadvertently overfly helicopter 30.

It should also be appreciated that a number of helicopter rotor fouling apparatuses 10 can be employed to fire a number of fouling lines 12 parallel to one another to form a grid or array of slowly descending lines to foul the rotor system of a helicopter.

In addition to fouling the rotor system of a helicopter to down a helicopter, it should further be appreciated that the deployment of fouling line 12 also serves to prevent a helicopter from entering a localized space as long as fouling line 12 is located in the space. Thus, to prevent helicopters from landing for a length of time, a number of helicopter rotor fouling apparatuses can be employed sequentially to always provide a fouling line 12 in the localized space and thus prevent the helicopter from entering that space.

Although the present invention has been described with respect to an exemplary embodiment thereof, it will be understood by those of ordinary skill in the art that variations and modifications can be effected within the scope and spirit of the invention.

What is claimed is:

1. A method of fouling a rotor system of a helicopter positioned within a localized space comprising the steps of:

attaching one end of a long flexible line to a carrier, the line being located at an initial launch point;

propelling the carrier from the launch point so as to overfly the localized space;

playing out the long flexible line progressively from the launch point and over the localized space as the carrier overflies the localized space;

terminating the playing out of the flexible line before the distal end is substantially pulled from the ground such that the played out line falls to the ground over the localized space with the distal end trailing on the ground whereby the falling line fouls the blades of a helicopter located in the localized space.

2. A method of fouling a helicopter blade as claimed in claim 1 wherein the terminating the playing out of the flexible line includes the step of opening a parachute attached to the one end of the flexible line such that the line slowly floats to the ground.

3. A method of fouling a helicopter blade as claimed in claim 2 and further including the step of attaching the carrier to the parachute so that both the carrier and flexible line float to the ground.

4. A method of fouling a helicopter blade as claimed in claim 2 and further including the step of attaching the distal end of the line to a device used to launch the carrier.

5. A method of fouling a helicopter blade as claimed in claim 2 and further including the step of concurrently terminating the playing out of a number of lines from respective carriers having trajectories approximately parallel to one another to form a grid or net of slowly descending lines whereby a large localized space is provided in which the rotor system of a helicopter is fouled.

6. An apparatus for fouling a rotor system of a helicopter positioned in a localized space comprising:

a carrier located initially at a launch point;

a propelling means for said carrier for propelling said carrier so as to overfly the localized space;

a long flexible line including a means for playing out said line located at the launch point, said line including a proximal end attached to said carrier and a distal end which trails on the ground;

a terminating means for terminating the playing out of said line by said carrier after overflying the localized space and before said distal end of said line leaves the ground.

7. An apparatus for fouling a rotor system as claimed in claim 6 wherein said terminating means includes a parachute means for slowly floating said proximal end of said line to the ground after overflying the localized space.

8. An apparatus for fouling a rotor system as claimed in claim 7 wherein said parachute means also floats said carrier to the ground with said line.

9. An apparatus for fouling a rotor system as claimed in claim 6 wherein said carrier is a transportable rocket means including a rocket and a launch tube for said rocket.

* * * * *